US007449984B2

(12) United States Patent
Kawarai

(10) Patent No.: US 7,449,984 B2
(45) Date of Patent: Nov. 11, 2008

(54) MAGNETIC ELEMENT AND METHOD OF MANUFACTURING MAGNETIC ELEMENT

(75) Inventor: Mitsugu Kawarai, Chouou-ku (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 11/379,934

(22) Filed: Apr. 24, 2006

(65) Prior Publication Data

US 2006/0186979 A1 Aug. 24, 2006

Related U.S. Application Data

(62) Division of application No. 11/005,439, filed on Dec. 6, 2004.

(51) Int. Cl.
*H01F 27/02* (2006.01)

(52) U.S. Cl. ..... 336/83

(58) Field of Classification Search ..... 336/200, 336/83

See application file for complete search history.

(56) References Cited

U.S. PATENT DOCUMENTS 5,062,197 A * 11/1991 Ngo et al. ..... 29/606
6,392,525 B1 * 5/2002 Kato et al. ..... 336/233

FOREIGN PATENT DOCUMENTS

| | | |
|---|---|---|
| JP | 05-283251 | 10/1993 |
| JP | 2000-182845 | 6/2000 |
| JP | 2001-185421 | 7/2001 |
| JP | 2002-057050 | 2/2002 |
| JP | 2002-313632 | 10/2002 |
| JP | 2002-359118 | 12/2002 |

* cited by examiner

*Primary Examiner*—Elvin G Enad
*Assistant Examiner*—Joselito Baisa
(74) *Attorney, Agent, or Firm*—Stephen Chin; von Simson & Chin LLP

(57) ABSTRACT

There are provided a magnetic element capable of enhancing magnetic permeability of a magnetic member, improving a direct current superposition characteristic, and improving production efficiency and a method of manufacturing the magnetic element. The magnetic element includes a coil (30) formed of a conductor having an insulating film, a first core member (20) constituted of insulative soft magnetic ferrite and covering the coil (30), and a second core member (50) having soft magnetic metal powder as material and surrounded by the first core member (20). Furthermore, the magnetic element includes a third core member (40) which has soft magnetic metal powder as material and a higher filling ratio of the soft magnetic metal powder than the second core member 50 and is surrounded by the first core member (20).

9 Claims, 15 Drawing Sheets

FIG. 16

| POWDER FILLING RATIO (%) OF PRESS BODY 40 | INDUCTANCE (μH) | CURRENT OF L-10%(A) |
|---|---|---|
| NONE | 4. 9 | 1. 35 |
| 65 | 4. 95 | 1. 38 |
| 70 | 5. 3 | 1. 5 |
| 75 | 5. 7 | 1. 55 |
| 80 | 6. 4 | 1. 59 |
| 85 | 6. 6 | 1. 64 |

L-10% IS CURRENT VALUE WHEN L VALUE DECREASES 10%

FIG.18

| STRUCTURE | POWDER FILLING RATIO (%) OF PRESS BODY 40 | INDUCTANCE (μH) | CURRENT OF L-10%(A) |
|---|---|---|---|
| FIG.12 | 80 | 6.4 | 1.59 |
| FIG.13 | 80 | 6.5 | 1.61 |
| FIG.14 | 80 | 6.3 | 1.57 |
| FIG.15 | 80 | 6.9 | 1.72 |

L-10% IS CURRENT VALUE WHEN L VALUE DECREASES 10%

MAGNETIC ELEMENT AND METHOD OF MANUFACTURING MAGNETIC ELEMENT

CROSS-REFERENCES TO RELATED APPLICATIONS

This application is a divisional application of Ser. No. 11/005,439 filed Dec. 6, 2004, which claims priority of Japanese Application Nos. 2003-412252 filed Dec. 10, 2003 and 2004-218726 filed Jul. 27, 2004, the entire disclosure of which are hereby incorporated by reference.

BACKGROUND OF THE INVENTION

1. Field of the Invention

The present invention relates to a magnetic element such as an inductor used in electric equipment and a method of manufacturing the magnetic element.

2. Description of the Related Art

In recent years, further improvement in performance of magnetic elements such as an inductor is demanded. Together with this improvement in performance, downsizing of magnetic elements is also requested, so that the size of the magnetic elements cannot be made larger for the purpose of improving performance. On the other hand, currently available magnetic elements include a drum type, a lamination type, and the like.

A schematic structure of a magnetic element of drum type is shown in FIG. 20. In the magnetic element of drum type, an air gap 103 exists between an upper flange portion 101 and a lower flange portion 102 of a drum type core 100 included in the magnetic element, and the existence of the air gap secures extension (which means not to decrease) of an L value (inductance) in a direct current superposition. However, when the air gap 103 exists, there is a problem of magnetic flux leakage to the outside. Also, when the air gap 103 exists, the L value decreases slightly.

Further, in the magnetic element of drum type, if downsizing (thinning) is advanced, the upper flange portion 101 and the lower flange portion 102 constituting the drum type core 100 become thin. Accordingly, when stress is applied to the upper flange portion 101 and the lower flange portion 102, the risk of breakage increased. In other words, there is a certain degree of limitation in downsizing of the magnetic element of drum type. Further, in addition to the problem of breakage, when downsizing of the magnetic element of drum type advances, it becomes difficult to reduce resistance to an electric current as compared to a magnetic element of large size, so that a large current cannot flow. Furthermore, it is demanded that decrease of an inductance (L value) in direct current superposition in a magnetic element is low, and also it is demanded that a loss in a high frequency region is small.

Incidentally, as a technique to obtain a large L value in the above-described magnetic element of drum type, it is conceivable to arrange a material having high magnetic permeability (ferrite for example) at the position of the air gap. However, when a material having high magnetic permeability such as ferrite is arranged, magnetically saturation can easily occur, and inversely, the magnetic permeability decreases at a predetermined current value or larger, which finally becomes equal to that of an air-core coil. Thus, the magnetic permeability of a material to be arranged should be suppressed to a certain degree. Further, in order to obtain a large L value, other factors (cross sectional area of a magnetic path for example) which decide the inductance may be changed. However, such a change leads to enlargement of the magnetic element, so that it goes against the request for downsizing.

Consequently, it is difficult to realize a magnetic element that has a large inductance, an excellent direct current superposition characteristic, and a small loss in a high frequency region.

Further, as one type that can be downsized (thinned) among other types of magnetic elements (types of magnetic elements other than the drum type), there is a magnetic element of lamination type. This magnetic element of lamination type is manufactured by laminating in a sheet form, or by using a technique of laminating by printing, and the like. Here, the magnetic element of lamination type is used for a signal of minute electric current, or the like in the current situation. However, the magnetic element of lamination type cannot respond to a large current due to structural limitation, magnetic characteristic limitation, and so on, and in such cases, it cannot function adequately as an inductor.

Specifically, when downsizing is advanced in either of the drum type and the lamination type, generally a characteristic thereof deteriorates. Therefore, improvement in the characteristic is demanded.

Here, as a technique to solve such problems, there is a magnetic element disclosed in Japanese Patent Application Laid-open No. 2001-185421 (refer to Abstract, FIG. 1, FIG. 2, and so on). For the magnetic element disclosed in this patent application, there is adopted a structure such that the L value is increased by eliminating the air gap, and in order to suppress occurrence of magnetic saturation, paste (also referred to as composite; the magnetic member A in the above-described patent document) constituted of metal powder and resin intervenes in a portion of the conventional air gap, and the circumference of a coil is covered by the magnetic member A. Incidentally, when such a structure is adopted, it is found that the magnetic permeability of the magnetic member A constituted of the paste contributes more to the L value and the like than the magnetic permeability of the magnetic member B (ferrite).

In the magnetic member A of the magnetic element disclosed in the above-described patent document, metal powder and resin are mixed in a constant ratio so as to secure fluidity of the paste. Meanwhile, when it is attempted to further improve the magnetic permeability of such a magnetic member A without sacrificing a direct current superposition characteristic, it is conceivable to increase the amount (ratio) of metal powder. However, when the amount of metal powder is increased in the paste, the fluidity of uncured paste is inhibited by that amount. Accordingly, formability thereof deteriorates, and the paste cannot enter a small gap such as a space between windings of a coil, thereby causing a problem that the occurrence of defects increases. Further, since the fluidity of the paste is low, there is also a problem that the production efficiency thereof deteriorates.

Moreover, in a structure having an upper flange portion and a lower flange portion similarly to the magnetic element disclosed in the above-described patent document, the magnetic member A constituted of paste having fluidity flows out while manufacturing. Accordingly, a manufacturing cost thereof is high due to a need of dedicated jig, or the like.

SUMMARY OF THE INVENTION

The present invention has been made in view of the above-described situation, and an object thereof is to provide a magnetic element capable of enhancing the magnetic permeability of a magnetic member and improving a direct current superposition characteristic thereof, the magnetic element which can be easily manufactured, and a method of manufacturing the magnetic element.

In order to solve the above-described problems, a magnetic element according to the present invention is characterized by including: a plate formed of insulative soft magnetic ferrite; a coil formed of a conductor having an insulating film and arranged in the plate; and terminal electrodes connected respectively to end portions of the coil and arranged outside of the plate, in which the coil in the plate is buried by a mixing material mainly constituted of magnetic metal powder and resin.

Further, in addition to the above-described invention of magnetic element, another invention is characterized in that the mixing material and the terminal electrodes are not in contact with each other.

Furthermore, in addition to the above-described invention of magnetic element, still another invention is characterized in that the coil is formed by patterning metal on a heat resistant resin film.

Further, in addition to the above-described invention of magnetic element, still another invention is characterized in that, in the mixing material, 75 vol % to 95 vol % is magnetic metal powder and 25 vol % to 5 vol % is resin.

Furthermore, in addition to the above-described invention of magnetic element, still another invention is characterized in that, between windings of the coil, the mixing material does not exist.

Further, in addition to the above-described invention of magnetic element, still another invention is characterized in that the terminal electrodes are plated for preventing solder corrosion and securing solder wetting.

Furthermore, in addition to the above-described invention of magnetic element, still another invention is characterized in that the terminal electrodes has thermosetting resin as material, and the terminal electrodes are formed by heating and curing the thermosetting resin.

Further, a method of manufacturing a magnetic element to still another invention is characterized in that it includes the steps of: placing a coil formed of a conductor having an insulating film in a plate formed of insulative soft magnetic ferrite; forming terminal electrodes connected respectively to end portions of the coil on outside of said plate; and burying the coil in the plate by a mixing material mainly constituted of magnetic metal powder and resin.

Furthermore, in addition to the above-described invention of method of manufacturing a magnetic element, another invention is characterized in that the mixing material and the terminal electrodes are not in contact with each other.

Further, in addition to the above-described invention of method of manufacturing a magnetic element, still another invention is characterized in that the coil is formed by patterning metal on a heat resistant resin film.

Furthermore, in addition to the above-described invention of method of manufacturing a magnetic element, still another invention is characterized in that, in the mixing material, 75 vol % to 95 vol % is magnetic metal powder and 25 vol % to 5 vol % is resin.

Further, in addition to the above-described invention of method of manufacturing a magnetic element, still another invention is characterized in that, between windings of the coil, the mixing material does not exist.

Furthermore, in addition to the above-described invention of method of manufacturing a magnetic element, still another invention is characterized in that the terminal electrodes are plated for preventing solder corrosion and securing solder wetting.

Further, a magnetic element according to still another invention has: a coil formed by winding a conductor having an insulating film; a first core member constituted of insulative soft magnetic ferrite and surrounding the coil; a second core member having soft magnetic metal powder as material and surrounded by the first core member; and a third core member having soft magnetic metal powder as material, having higher magnetic permeability than the second core member, and surrounded by the first core member.

In such a structure, the third core member having the soft magnetic metal powder as material has higher magnetic permeability than the second core member similarly having the soft magnetic metal powder as material. Accordingly, by the amount of existence of the third core member, the inductance of the magnetic element can be increased. Further, the third core member has the metal powder as material, so that the direct current superposition characteristic can be made favorable while increasing the inductance.

Further, a magnetic element according to still another invention has: a coil formed by winding a conductor having an insulating film; a first core member constituted of insulative soft magnetic ferrite and surrounding the coil; a second core member having soft magnetic metal powder as material and surrounded by the first core member; and a third core member having soft magnetic metal powder as material, having a higher filling ratio of the soft magnetic metal powder than the second core member, and surrounded by the first core member.

In such a stricture, the third core member has a higher filling ratio of metal powder than the second core member. Thus, when the filling ratio of metal powder is made high, the percentage of air existing in the third core member can be reduced. Accordingly, the magnetic permeability of the third core member can be improved, and the inductance can be increased.

Furthermore, in still another invention, in addition to the above-described invention of magnetic element, the second core member is formed by curing of paste having fluidity, and the paste has, besides the soft magnetic metal powder, thermosetting resin as material. In such a structure, before the thermosetting resin cures, the second core member is in a paste form having fluidity. Accordingly, the paste can flow into spaces between small recesses and projections existing in the coil, the first core member, or the like. Thus, the second core member is produced by curing of the paste, so that the magnetic element can be easily manufactured, and thus productivity thereof can be improved. Further, curing of the paste makes the third core member and the coil adhere securely to the first core member.

Further, in still another invention, in addition to the above-described invention of magnetic element, the third core member is formed by press forming of the soft magnetic metal powder. In such a structure, air gaps included in the third core member constituted of soft magnetic metal powder can be crushed by the press forming. Accordingly, the filling ratio of the third core member can be made higher than that of the second core member, and thus the magnetic permeability and the inductance of the magnetic element can be improved.

Furthermore, in still another invention, in addition to the above-described invention of magnetic element, in magnetic flux generated from the coil, a part passing through the first core member, the second core member, and the third core member one by one in serial order is larger than a part passing therethrough with at least one of the core members being excluded.

In such a structure, the magnetic flux generated from the coil mainly passes through the first core member, the second core member, and the third core member in serial order. Specifically, the magnetic flux generated from the coil also passes through the third core member having higher magnetic permeability than the second core member. Accordingly, the inductance of the magnetic element can be increased.

Further, in still another invention, in addition to the above-described invention of magnetic element, the first core member forms a cup body having a recessed fitting portion. In such a structure, the coil, the second core member and the third core member can be easily arranged in the recessed fitting portion. Especially in the case that the second core member is formed by curing of paste having fluidity, the paste can be easily received in the recessed fitting portion. Accordingly, productivity of the magnetic element can be improved. Further, the first core member is formed in a cup body, and not formed in a drum-type core having an upper flange portion and a lower flange portion. Thus, when it is attempted to make the magnetic element thin, it is possible to prevent occurrence of a problem such that the upper flange portion and the lower flange portion become thin and easily breakable. Therefore, when it is possible to make the magnetic element thin, strength of the magnetic element can be secured.

Furthermore, in still another invention, in addition to the above-described invention of magnetic element, the third core member is formed in a column shape, an end surface of one end side of the column shape is mounted on a bottom portion of the cup body, and the third core member in the column shape is covered by the second core member.

In such a structure, since the third core member is formed in a column shape, it becomes possible to arrange the third core member in the core portion of the coil. Accordingly, the inductance can be improved. Further, since the third core member covers the second core member, magnetic flux can mainly pass through the first core member, the second core member and the third core member in serial order.

Further, in still another invention, in addition to the above-described invention of magnetic element, the third core member is formed in a column shape, an end surface of one end side of the column shape is mounted on a bottom portion of the cup body, and the third core member in the column shape is formed to be level with an end surface of the second core member.

In such a structure, the volume of the third core member in the recessed fitting portion increases. Accordingly, inside the recessed fitting portion, the percentage of the third core member having high magnetic permeability increases, and thus the inductance of the magnetic element can be increased.

Furthermore, in still another invention, in addition to the above-described invention of magnetic element, the third core member is formed in a lid body shape, and the third core member in the lid body shape is mounted on the second core member and blocks an opening portion of the cup body.

Also in such a structure, inside the recessed fitting portion, the volume of the third core member having high magnetic permeability can be increased. Further, in magnetic flux generated from the coil, the percentage of magnetic flux mainly passing through the first core member, the second core member and the third core member in serial order can be increased. Accordingly, an advantage of increasing the inductance of the magnetic element can be achieved.

Further, in still another invention, in addition to the above-described invention of magnetic element, the third core member includes a lid body portion in a lid body shape and a column portion in a column shape extending in a normal direction of the lid body portion from a center portion of the lid body portion; with the lid body portion and the column portion, a cross section of the third core member forms a T shape; and between the third core member and a bottom portion of the cup body, the second core member intervenes.

In such a structure, inside the recessed fitting portion, the volume of the third core member having high magnetic permeability can be largely increased. Further, in magnetic flux generated from the coil, a main part can pass through the first core member, the second core member and the third core member in serial order. Therefore, the inductance of the magnetic element can be increased.

Furthermore, in still another invention, in addition to the above-described invention of magnetic element, the coil is formed by patterning of metal on a heat resistant resin film. In such a structure, the coil to be wound in a desired shape can be easily wound.

Further, in still another invention, in addition to the above-described invention of magnetic element, between windings of the coil, the second core member does not exist. In such a structure, occurrence of a minor loop of magnetic flux going around the windings of the coil can be suppressed, and thus an appropriate flow of magnetic flux can be secured.

Furthermore, in still another invention, in addition to the above-described invention of magnetic element, the magnetic element further includes an external electrode electrically connected to the coil and attached to an outer peripheral surface of the first core member, in which the external electrode is formed of electrically conductive adhesive as material.

In such a structure, the coil is electrically connected to the external electrode constituted of the electrically conductive adhesive.

According to the present invention, in the magnetic element, the magnetic permeability of the magnetic members can be made high and the direct current superposition characteristic can be improved. Further, the magnetic element can be easily manufactured.

BRIEF DESCRIPTION OF THE DRAWINGS

FIG. 16 is a table showing characteristics in the case that a filling ratio is changed in the inductor in FIG. 12;

FIG. 18 is a table showing characteristics of respective inductors in FIG. 12 to FIG. 15 in a state that a filling ratio is fixed to 80%;

DETAILED DESCRIPTION OF THE PREFERRED EMBODIMENTS

First Embodiment

Figure 1:
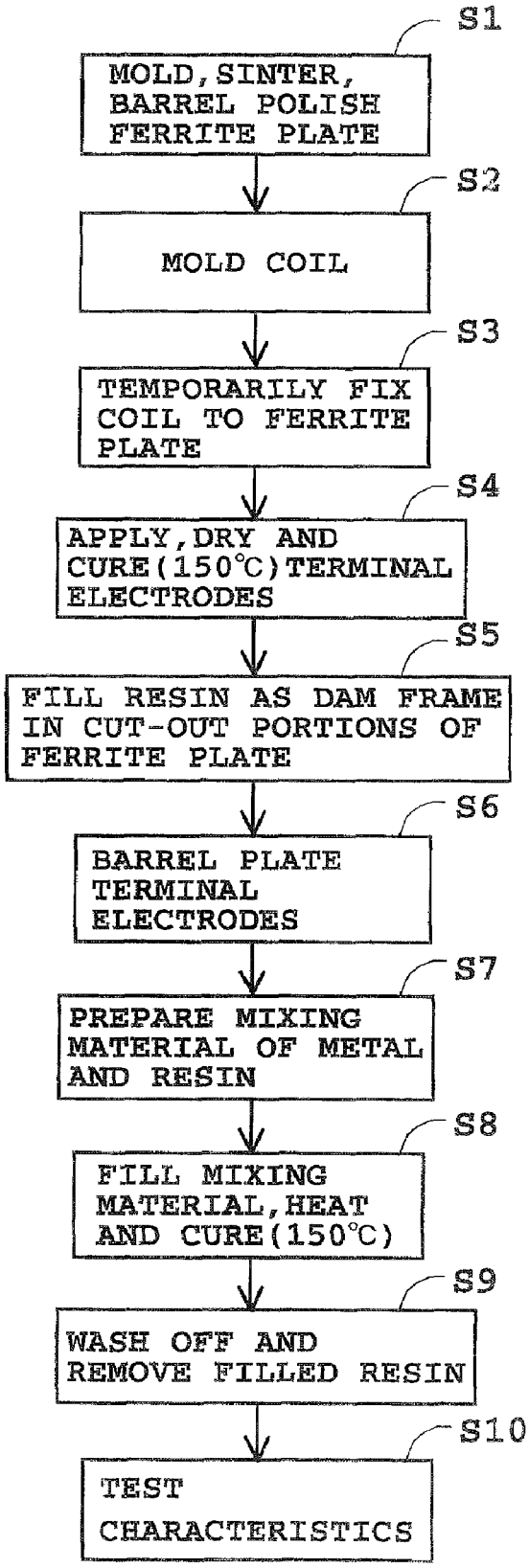
FIG. 1 is a view showing an example of manufacturing steps of an inductance element according to the present invention.

An inductance element as a magnetic element in this embodiment has realized by a simple structure an object to be usable for a power supply despite its thinness. Hereinafter, a first embodiment of the present invention will be described using examples based on FIG. 1 to FIG. 11. In each drawing, the same components are designated the same reference numerals, and overlapping descriptions thereof are omitted. In the following description, it should be noted that the structure of an inductance element will be described while showing manufacturing steps.

EXAMPLE 1

Figure 2:
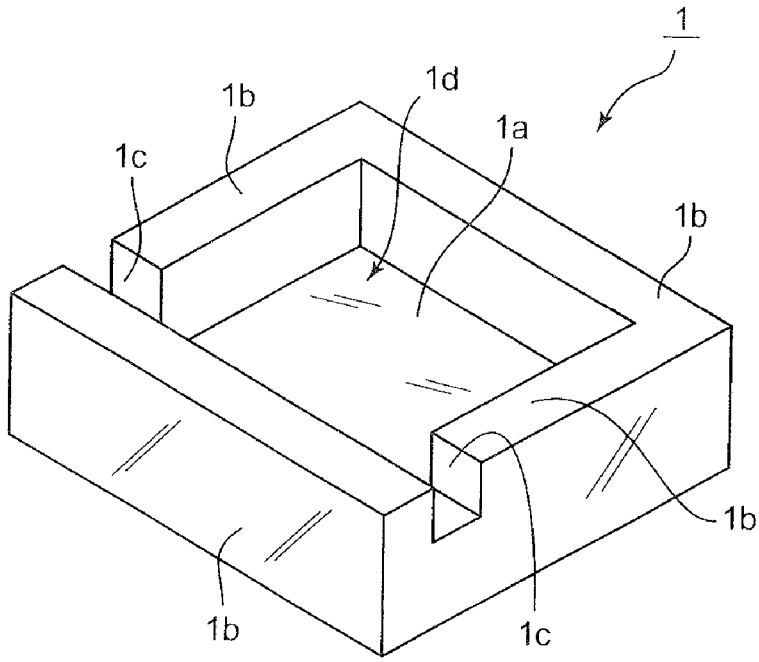
FIG. 2 is a perspective view showing the structure of a ferrite plate in the inductance element according to an example 1 of the present invention.

FIG. 1 shows a table of manufacturing steps of an inductance element according to an example 1. In the manufacturing steps, first, a plate 1 (ferrite plate) is molded with ferrite and sintered, and a barrel polishing is performed thereto (S1). A perspective view of the plate 1 produced as such is shown in FIG. 2. The plate 1 has a square prism shape with a bottom. Specifically, the plate 1 has a bottom 1*a* whose planar shape is a quadrangle and four side walls 1*b* surrounding an outer peripheral edge portion of the bottom 1*a* toward an upper side that is described later in a circumferential direction without any gaps. Thus, the plate 1 has a cup shape whose cross section is substantially a U shape. Incidentally, a portion of the plate 1 surrounded by the bottom 1*a* and the side walls 1*b* is referred to as a recessed portion 1*d*.

Among the side walls 1*b*, cut-out portions 1*c*, 1*c* are formed respectively in two opposing side walls 1*b*, 1*b*. The cut-out portions 1*c*, 1*c* are each formed in the side walls 1*b*, 1*b* in a long side direction at a position adjacent to one side wall 1*b* (side wall 1*b*1) in which the cut-out portion 1*c* is not formed. The cut-out portions 1*c*, 1*c* are each formed by cutting out the center portion of the side wall 1*b* downward with a predetermined dimension in a rectangular shape. In the cut-out portions 1*c*, 1*c*, end portions of a later-described coil 3 are arranged respectively. Incidentally, the shape of the plate 1 is not limited to a square prism shape, which may be a cylindrical shape.

Figure 3:
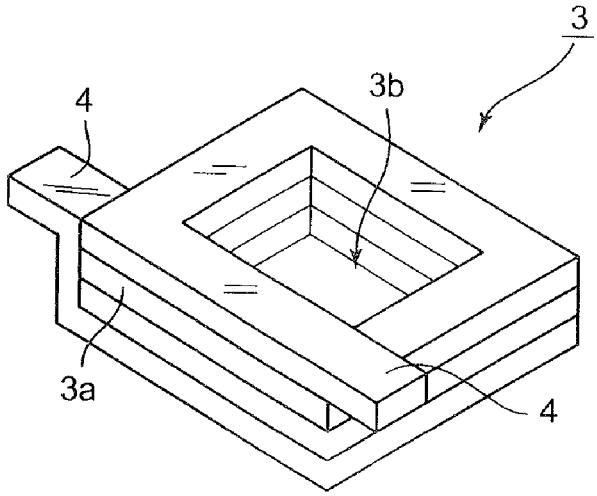
FIG. 3 is a perspective view showing the structure of a coil in an inductance element according to the example 1 of the present invention.

Next, the coil 3 is formed (S2). This coil 3 is constituted of a conductor 3*a* in which an electrical conductor is covered by an insulating film such as an enamel or the like for example, and in this embodiment, the cross-sectional shape and the front shape of the conductor 3*a* is square shape. As shown in FIG. 3, the coil 3 is wound in a rectangular parallelepiped shape whose planar shape is a quadrangle in a state of having, for example, a square hole 3*b* at the center. Specifically, this coil 3 can be formed by bending a flat wire or by patterning metal such as copper on a heat resistant resin film. Incidentally, the coil 3 may be one made by winding the conductor 3*a* in a cylindrical shape.

Further, after such winding, when the coil 3 is placed in the recessed portion 1*d* of the plate 1, one end of the conductor 3*a* is approximately level with the lower surface of the cut-out portion 1*c*, but the other end of the conductor 3*a* is not approximately level with the lower surface of the cut-out portion 1*c*. Accordingly, the other end of the conductor 3*a* is bent at approximately 90 degree upward, and is bent again at approximately 90 degree toward the outer diameter side at substantially the same height position of the conductor 3*a*. Consequently, the one end and the other end of the conductor 3*a* can be favorably lead out respectively from the cut-out portion 1*c* of the conductor 3*a* toward the outside.

Figure 5:
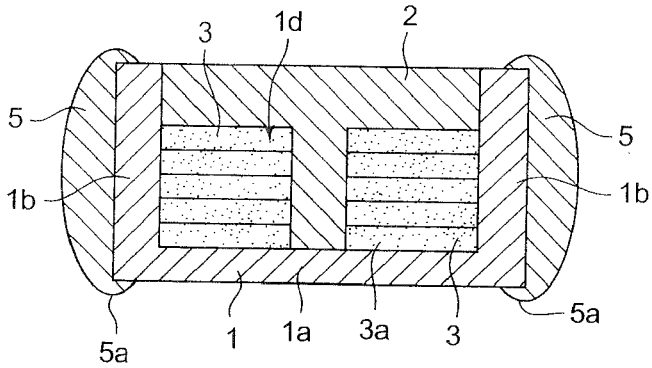
FIG. 5 is a cross-sectional view of the inductance element taken along the line A-A in FIG. 4.
Figure 6:
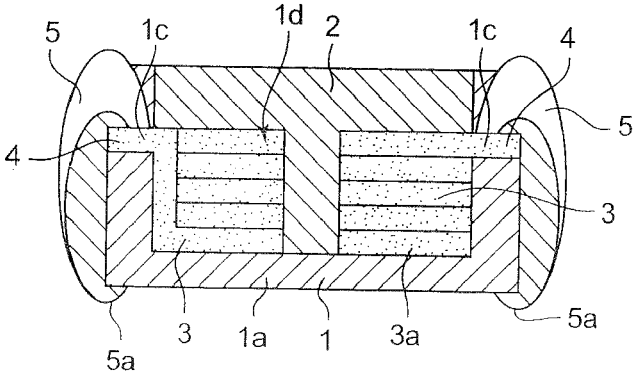
FIG. 6 is a cross-sectional view of the inductance element taken along the line B-B in FIG. 4.

Next, the coil 3 is placed in the recessed portion 1*d* of the ferrite plate 1, and the end portions 4 of the coil 3 are arranged respectively in the cut-out portions 1*c*, 1*c* and temporarily fixed (S3). Then, terminal electrodes 5 constituted mainly of silver are applied so as to be connected respectively to the end portions 4 of the coil 3 and are heated and cured at 150° C. (S4). In this case, as shown in FIG. 5 and FIG. 6, the terminal electrodes 5 are applied so as to reach the positions where the cut-out portions 1*c*, 1*c* are formed on the outer peripheral surfaces of the side walls 1*b*. Incidentally, regarding such application, the terminal electrodes 5 are applied in a state of reaching a rear side of the bottom portion 1*a* (hereinafter, this portion is referred to as a mounting portion 5*a*). Accordingly, when mounting the inductance element on a substrate or the like, the mounting portion 5*a* can be in contact with the substrate or the like in a state of having a predetermined area, and it becomes also possible to mount the inductance element in surface mounting. Incidentally, the terminal electrodes 5 are arranged to be exposed to the outside of the plate 1 in a non-contact state with a later-described mixing material 2.

Next, in the cut-out portions 1*c*, 1*c* of the ferrite plate 1, resin is filled in upper portions of the end portions 4 of the coil 3 to form a dam frame (S5). Accordingly, the inside of the cut-out portions 1*c*, 1*c* is in a state that the dam frame is positioned above the end portions 4, which prevents flowing out of a mixing material 2 that will be filled later to the outside of the ferrite plate 1. Further, formation of the dam frame enables control of a dimension between the mixing material 2 and the terminal electrodes 5. Then, barrel plating is performed on the terminal electrodes 5 which are applied in the above-described step S4 (S6). This barrel plating process is a process for preventing solder corrosion and securing solder wettability.

Next, the mixing material 2 mainly constituted of magnetic metal powder and resin is prepared (S7). The mixing material 2 is one securing fluidity by mixing thermosetting resin in soft magnetic metal powder, which is not pressure formed particularly. In this mixing material 2, 75 vol % to 95 vol % is magnetic metal powder and 25 vol % to 5 vol % is resin. Then, the prepared mixing material 2 is poured from an upper part of the coil 3 inserted in the ferrite plate 1 in FIG. 2. Accordingly, the coil 3 is buried in the mixing material 2, and at the same time the mixing material 2 is filled in the recessed portion 1*d* of the ferrite plate 1. Further, after filling the mixing material 2 in the recessed portion 1*d*, the mixing material 2 is heated and cured at 150° C. (S8). Subsequently, the resin (for the dam frame) filled in advance in the step S5 is washed and removed (S9).

Incidentally, in the above-described filling, the mixing material 2 is in a state of not entering between windings of the coil 3 (between adjacent conductor 3*a* and conductor 3*a*). Further, when it is desired to secure (adjust) fluidity in the above-described mixing material 2, powder shape of the metal powder may be adjusted. For example, when the metal powder has a needle shape or a shape having many projections, fluidity of the paste becomes low. However, when the metal powder is similar to a spherical shape, the fluidity becomes high, and thus the powder can easily enter between small recesses and projections. In this embodiment, such an adjustment of fluidity with respect to the shape of the metal powder may be performed.

Figure 4:
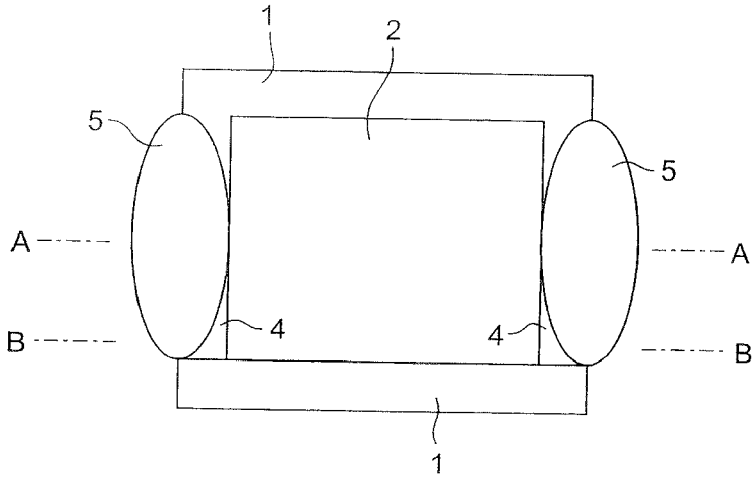
FIG. 4 is a plan view showing the structure of the inductance element according to the example 1 of the present invention.

By the above-described washing and removing of the resin, the inductance element is produced, and a characteristic test (characteristic inspection) is performed (S110) to complete the production. FIG. 4 shows a plan view of the completed inductance element, FIG. 5 shows a cross-sectional view taken along the line A-A in FIG. 4, and FIG. 6 shows a cross-sectional view taken along the line B-B in FIG. 4. As is clear from FIG. 4 to FIG. 6, in the manufacturing steps, by controlling the dimension between the mixing material 2 and the terminal electrodes 5 in the step S5 or by performing the process of filling the heat resistant insulating resin between the mixing material 2 and the terminal electrodes 5, the mixing material 2 and the terminal electrodes 5 become non-contact with each other. Therefore, it is not necessary to use an insulating material for the magnetic material which constitutes the core portion, which has large advantages in manufacturing steps and costs.

Further, since the conductor 3*a* constituting the coil 3 is insulation coated, it is not necessary to use an insulating material for the magnetic material functions as the core. Accordingly, the inductance element can be used for a power supply, such as a power supply line. Furthermore, the structure in which the mixing material 2 does not intervene between windings of the coil 3 is adopted. Accordingly, occurrence of a minor loop of magnetic flux going around the conductor 3*a* in every one conductor 3*a* of the coil 3 can be suppressed, and thus an appropriate flow of magnetic flux can be secured.

Figure 7:
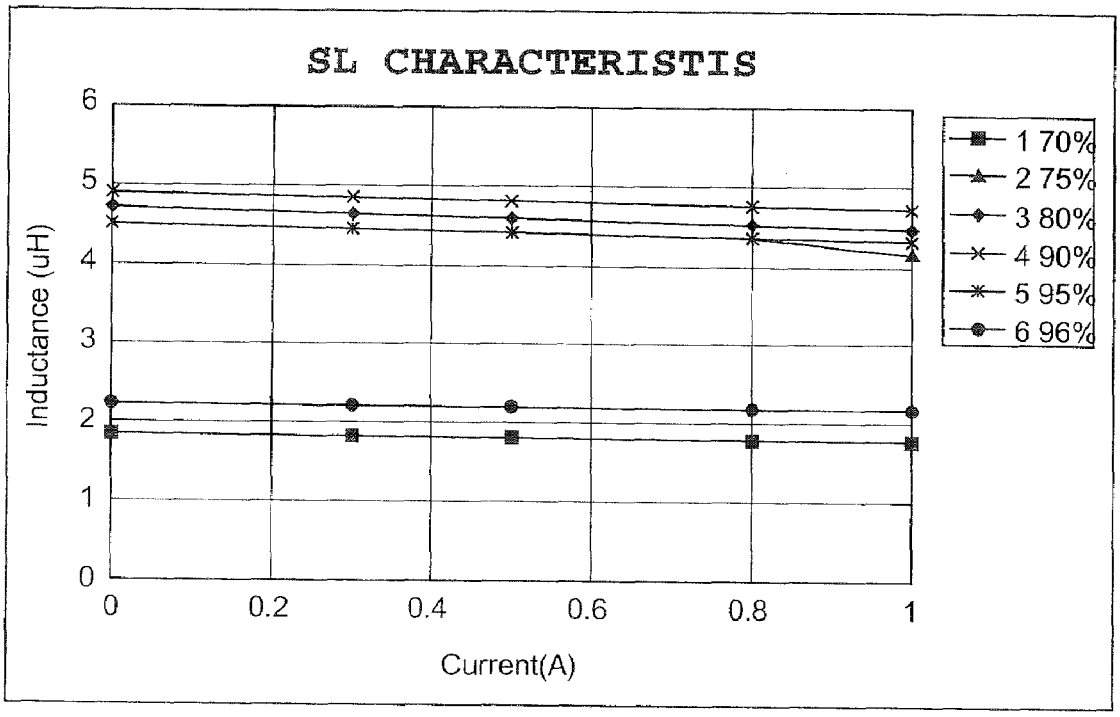
FIG. 7 is a view showing characteristics of current-inductance values in the case that composition of a mixing material is changed diversely in the inductance element according to the present invention.

Furthermore, in the mixing material 2, since the magnetic metal powder is 75 vol % to 95 vol %, and the resin is 25 vol % to 5 vol %, an inductance element having a high inductance value can be obtained. FIG. 7 shows characteristics of current-inductance values in the cases that the magnetic metal powder is 70, 75, 80, 90, 95, 96 vol % respectively. As is clear from FIG. 7, the inductance value in the cases that the magnetic metal powder is 70 vol % and 96 vol % respectively is considerably lower than the inductance value in the cases that the magnetic metal powder is 75 vol % to 95 vol %. In other words, in the mixing material 2, a mixing ratio to include 75 vol % to 95 vol % of magnetic metal powder and 25 vol % to 5 vol % of resin is preferable.

Incidentally, as the soft magnetic ferrite constituting the mixing material 2, Fe—Si based magnetic material such as permalloy and sendust, Fe—Cr based magnetic material, or Ni based magnetic material can be adopted. Further, regarding the preparation of the mixing material 2 mainly constituted of magnetic metal powder and resin in the step S7, it is satisfactory as long as the mixing material 2 can be filled in the step S8, so that it is not a prerequisite to prepare the mixing material 2 immediately before the step S8.

EXAMPLE 2

Figure 8:
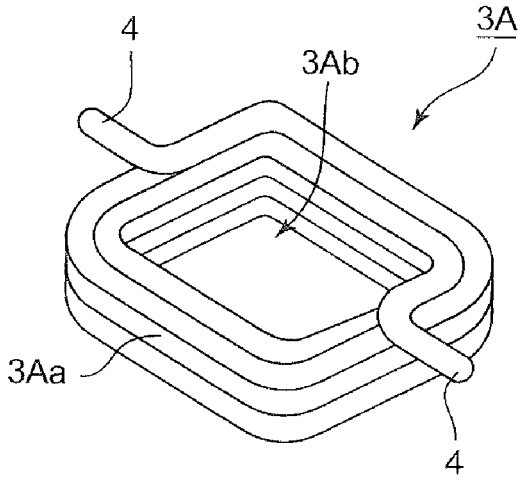
FIG. 8 is a perspective view showing the structure of a coil in an inductance element according to an example 2 of the present invention.

In an example 2, a coil 3A shown in FIG. 8 is used. The coil 3A is constructed by winding a conductor 3Aa which is insulation coated and has a circular cross-section or front shape. Similarly to the coil 3, the coil 3A is wound in a rectangular parallelepiped shape whose planar shape is a quadrangle in a state of having, for example, a square hole 3Ab at the center. Incidentally, as the coil 3A, the conductor 3Aa wound in a cylindrical shape may be used. Furthermore, the coil 3A is constituted of the conductor 3Aa in which an electrical conductor is covered by an insulating film. The insulating film in this embodiment is made of a fusing material that fuses by, for example, heating, pouring solvent such as alcohol, or the like. Accordingly, when such fusing is performed, spaces between the conductors 3Aa can be eliminated by adhesion, which provides a structure in which the mixing material 2 does not intervene between the conductors 3Aa of the coil 3A. Thus, it is possible to suppress occurrence of a minor loop of magnetic flux going around the conductor 3Aa in every one conductor 3Aa of the coil 3A, and thus an appropriate flow of magnetic flux can be secured.

Incidentally, with a structure other than the one in which the material of the insulating film is the fusing material, the mixing material 2 may be prevented from intervening between the conductors 3Aa. For example, after the coil 3A is formed, a general method such as dipping, spraying, or the like is used to coat the coil 3A with resin. Also in this case, intervention of the mixing material 2 between the conductors 3Aa can be favorably prevented.

Figure 9:
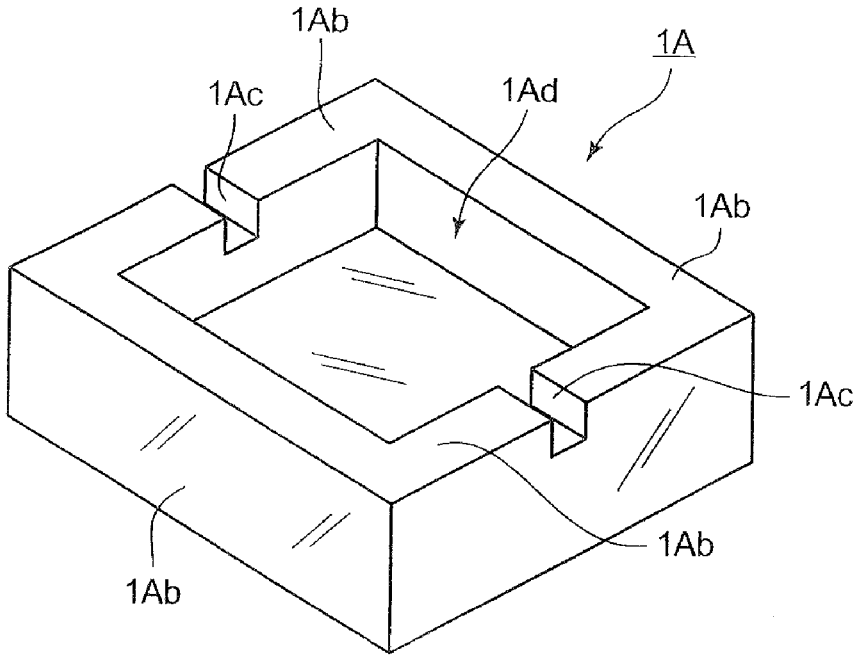
FIG. 9 is a perspective view showing the structure of a ferrite plate in the inductance element according to the example 2 of the present invention.

Further, as shown in FIG. 9, the plate 1A has basically the same structure as the plate 1 (refer to FIG. 2) in the example 1. However, in the plate 1A in this embodiment, positions where cut-out portions 1Ac, 1Ac are formed are different from the positions of the cut-out portions 1*c*, 1*c* in the example 1. Specifically, the cut-out portions 1Ac, 1Ac are each formed at substantially the center portion in a long side direction of each of side walls 1Ab, 1Ab. Incidentally, similarly to the cut-out portions 1*c*, 1*c*, the cut-out portions 1Ac, 1Ac are each formed by cutting out the center portion of the side wall 1Ab downward with a predetermined dimension in a rectangular shape.

Manufacturing steps of an inductance element using such a plate 1A and a coil 3A are in accordance with the table of manufacturing steps in FIG. 1 described in the example 1. Incidentally, also in this example 2, regarding the preparation of the mixing material 2 mainly constituted of magnetic metal powder and resin in the step S7, it is satisfactory as long as the mixing material 2 can be filled in the step S8, so that it is not a prerequisite to prepare the mixing material 2 immediately before the step S8.

Figure 10:
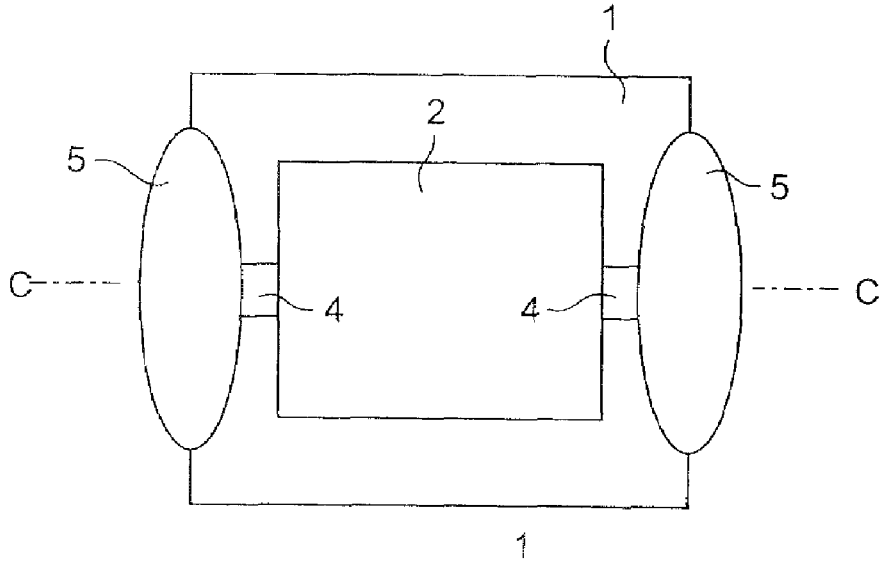
FIG. 10 is a plan view showing the structure of the inductance element according to the example 2 of the present invention.
Figure 11:
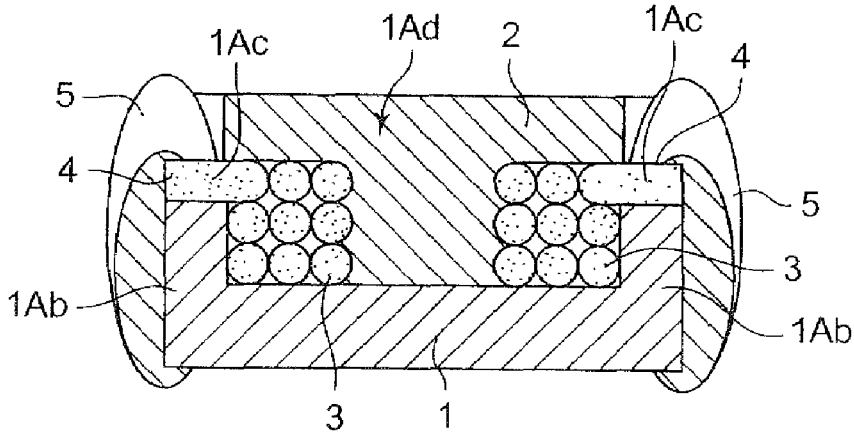
FIG. 11 is a cross-sectional view of the inductance element taken along the C-C line in FIG. 10.

Regarding the inductance element according to the example 2, a plan view of a completed inductance element is shown in FIG. 10. Further, in FIG. 11, a cross-sectional view taken along the line C-C in FIG. 10 is shown. As is clear from FIG. 10 and FIG. 11, in the manufacturing steps, by controlling the dimension between the mixing material 2 and the terminal electrodes 5 in step S5 or by performing a process of filling heat resistant insulating resin between the mixing material 2 and the terminal electrodes 5 in a recessed portion 1Ad, the mixing material 2 and the terminal electrodes 5 become non-contact with each other. Therefore, it is not necessary to use an insulating material for the magnetic material which constitutes the core portion, which has large advantages in manufacturing steps and costs.

Further, since the conductor 3Aa constituting the coil 3A is insulation coated, it is not necessary to use an insulating material for the magnetic material functions as the core. Accordingly, the inductance element can be used for a power supply, such as a power supply line. Furthermore, the structure in which the mixing material 2 does not intervene between windings of the coil 3A is adopted. Accordingly, it is possible to suppress occurrence of a minor loop of magnetic flux going around the conductor 3Aa in every one conductor 3Aa of the coil 3A, and thus an appropriate flow of magnetic flux can be secured.

Furthermore, the composition of the mixing material 2 is the same as that in the example 1. Accordingly, the inductance element in the example 2 exhibits characteristics of current-inductance values as shown in FIG. 7 in the example 1.

Further, as the soft magnetic ferrite constituting the mixing material 2, Fe—Si based magnetic material such as permalloy and sendust, Fe—Cr based magnetic material, or Ni based magnetic material can be adopted.

Second Embodiment

Figure 12:
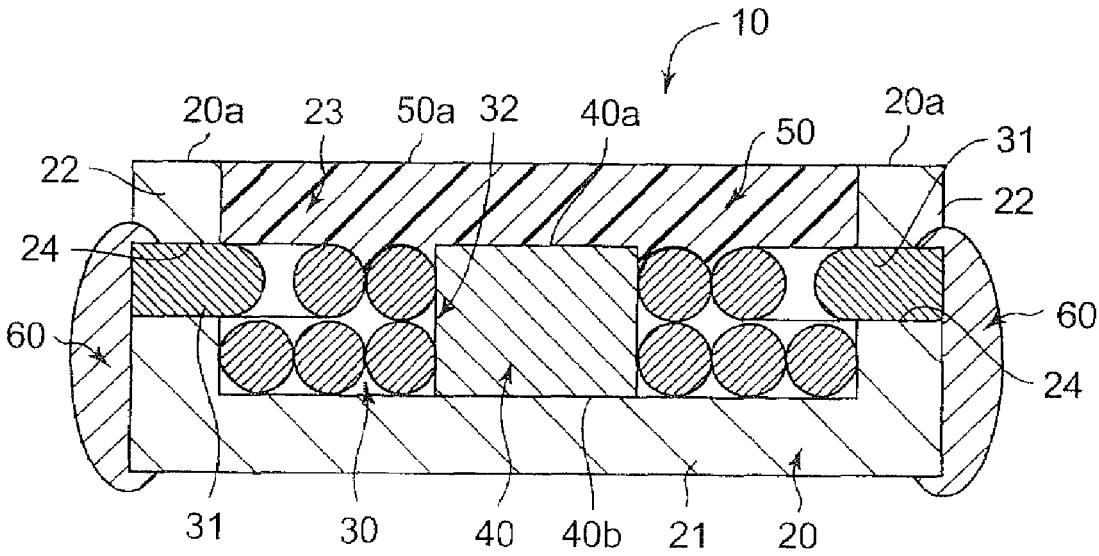
FIG. 12 is a cross-sectional side view showing the structure of an inductor according to a second embodiment of the present invention, showing a state that a pressed body is covered by a paste cured portion.

Hereinafter, an inductor as a magnetic element according to a second embodiment of the present invention will be described based on FIG. 12. FIG. 12 is a cross-sectional side view showing the structure of an inductor 10. As shown in FIG. 12, the inductor 10 has a cup body 20, a coil 30, a pressed body 40, a paste cured portion 50, coil terminals 31, and external electrodes 60.

The cup body 20 has an appearance of a cup shape having a bottom. The cup body 20 has a bottom portion 21 in a disc shape and an outer peripheral wall portion 22 surrounding an outer peripheral edge portion of the bottom portion 21 toward an upper side that is described later in a circumferential direction without any gaps. Surrounded by the bottom portion 21 and the outer peripheral wall portion 22, a recessed fitting portion 23 for fitting a later-described coil 30 and so on is formed. Incidentally, a side (the upper side that is described later) opposing the bottom portion 21 is open. Further, in the outer peripheral wall portion 22 of the cup body 20, a pair of holes 24 are formed. The holes 24 penetrate the outer peripheral wall portion 22 from the recessed fitting portion 23 side to the outer diameter side and lead out the later-described coil terminals 31 to the external electrodes 60 side. Specifically, the holes 24 are through holes each having a diameter corresponding to the coil terminal 31.

In the description below, it should be noted that, in the cup body 20, an open side opposing the bottom portion 21 when seen from the bottom portion 21 is referred to as upside (upper side), and the bottom portion 21 side opposing the open side when seen from the open side is referred to as downside (lower side). Further, instead of forming the holes 24, cut-out portions may be formed by cutting out the outer peripheral wall portion 22, for example, from the top toward the bottom by a predetermined depth. Also in such a structure, it is possible to favorably lead out the coil terminals 31 toward the external electrodes 60 side.

This cup body 20 corresponds to a first core member and is made of ferrite, which is a magnetic and insulative material. As the ferrite, there exist NiZn ferrite, MnZn ferrite, and the like. However, the material for the cup body 20 is not limited to ferrite, as long as it is magnetic and insulative material. Further, in the case that the later-described external electrodes 60 are not directly in contact with the cup body 20 so that the insulation can be secured between the external electrodes 60 and the cup body 20 (for example, in the case that resin or the like intervenes between the external electrodes 60 and the cup body 20 or the like), it is possible to use a material that is less insulative such as permalloy or the like as the material for the cup body 20.

The coil 30 is arranged in the recessed fitting portion 23. This coil 30 is constituted of, for example, a conducting wire in which an electrical conductor is covered by an insulating film such as an enamel for example, and the coil 30 is formed by winding the conducting wire for predetermined times. Incidentally, the coil 30 is a coreless coil at the time it is being arranged in the recessed fitting portion 23. Further, portions of the conducting wire not used for forming the coil 30 are the later-described coil terminals 31.

Further, in the coreless portion 32 of the coil 30, a pressed body 40 as a third core member is arranged. The pressed body 40 is made of soft magnetic metal powder and is formed by press forming this soft magnetic metal powder. An example of the soft magnetic metal powder constituting the pressed body 40 is powder mainly constituted of iron, such as sendust (Fe—Al—Si), permalloy (Fe—Ni), iron silicon chrome (Fe—Si—Cr), and the like. However, a soft magnetic material other than these may be used as the metal powder to form the pressed body 40.

In this embodiment, the pressed body 40 is formed in a column shape (rod shape). Further, the pressed body 40 has a length that is set so that an upper end surface 40*a* of the pressed body 40 is lower than an upper end surface 20*a* of the cup body 20 when a lower end surface 40*b* (corresponding to an end surface of one end side) of the column shape is mounted on the bottom portion 21. Specifically, the pressed body 40 is in a state not protruding from the recessed fitting portion 23 but being covered by the later-described paste cured portion 50.

Further, the paste cured portion 50 as a second core member is provided to covered the coil 30 and the pressed body 40. The paste cured portion 50 is made in such a manner that paste in an uncured state (a mixture of metal powder and thermosetting resin having fluidity before being cured to be the paste cured portion 50; also referred to as composite) is poured into the recessed fitting portion 23 and cured thereafter. Moreover, in this embodiment, an upper end surface 50*a* of the paste cured portion 50 is approximately level with (or exactly level with) the upper end surface 20*a* of the cup body 20. Accordingly, the paste cured portion 50 covers the upper side of the coil 30 and the pressed body 40 without any gaps, regardless of recesses and projections due to the existence of the coil 30 and the pressed body 40.

Here, in this embodiment, the paste cured portion 50 is in a state not entering between conducting wires of the coil 30 which are lower than the topmost layer thereof. Further, in this embodiment, the paste cured portion 50 is shown in the diagram, and thus the paste itself is not shown. Further, representative examples of the above-described thermosetting resin include epoxy resin, phenol resin, melamine resin, and the like.

Incidentally, in the paste which has fluidity at a stage before the paste cured portion 50 cures, an organic solvent is mixed in addition to the metal and the thermosetting resin, and as the curing proceeds, the organic solvent evaporates. Accordingly, after the paste cures and the paste cured portion 50 is formed, the metal powder and the thermosetting resin become the main constituents, and the paste cured portion 50 is in a state having an air gap corresponding to the amount of the evaporated organic solvent.

Further, the constituents of the paste cured portion 50 are 75 vol % to 95 vol % of magnetic metal powder and 25 vol % to 5 vol % of thermosetting resin. Here, "vol %" is a concept represented by (powder volume of metal or resin)/(powder volume of metal+powder volume of resin).

Here, the above-described pressed body 40 and paste cured portion 50 both having soft magnetic metal powder as a main constituent will be described in comparison. The pressed body 40 is made by press forming soft magnetic metal powder, which has a higher powder filling ratio than the paste cured portion 50. Here, the powder filling ratio is a concept represented by (metal powder volume)/(powder volume+resin volume+space part), which is a different concept from the above-described vol %.

Incidentally, in the pressed body 40, the resin volume is normally 0 to 4 wt %. Accordingly, when having the same volume, the powder filling ratio of the pressed body 40 becomes higher than that of the paste cured portion 50. However, in practice, the thermosetting resin enters the space part. Then, there may be a case that the powder filling ratio when pressure is not applied does not become drastically higher as compared to that of the paste cured portion 50. Accordingly, when producing the pressed body 40, press forming is performed to reduce the volume of the space part. Thus, the powder filling ratio of the pressed body 40 becomes higher than the powder filling ratio of the paste cured portion 50.

Incidentally, the powder filling ratio of metal powder in the pressed body 40 is preferably in a range of 70% to 90%, or more preferably in a range of 80% to 90%.

Further, in the paste cured portion 50, fluidity is secured by mixing thermosetting resin in soft magnetic metal powder, and the mixing material is not particularly press formed. As a result, a powder filling ratio thereof is decreased by the volume of resin and the amount of evaporating solvent.

Incidentally, when it is desired to secure (adjust) fluidity in the above-described paste, powder shape of the metal powder may be adjusted. For example, when the metal powder has a needle shape or a shape having many projections, fluidity of the paste becomes low. However, when the metal powder is similar to a spherical shape, the fluidity becomes high, and thus the powder can easily enter between small recesses and projections. In this embodiment, such an adjustment of fluidity with respect to the shape of metal powder may be performed.

Further, in the holes 24 of the cup body 20, the coil terminals 31 are inserted respectively. The coil terminals 31 are terminal portions of the conducting wire, which are continuous to the coil 30 and not forming the coil 30, and are portions lead out toward the outside from the recessed fitting portion 23. These coil terminals 31 are exposed to the outer surface of the outer peripheral wall portion 22. The external electrodes 60 as terminal electrodes are provided respectively at portions of the outer peripheral wall portion 22, which correspond to the exposure of the coil terminals 31.

Here, in this embodiment, the external electrodes 60 are formed in a pair (two in total) at symmetrical positions on the cup body 20, which correspond to the holes 24 respectively. However, the number of external electrodes 60 is not limited to two, which may be three or more. In such a case, the number of holes 24 may be increased according to the number of external electrodes 60.

Further, the external electrodes 60 are formed by applying electrically conductive adhesive including resin to the outer peripheral side of the outer peripheral wall portion 22 of the cup body 20. In addition, plating is performed on surfaces of the external electrodes 60. Therefore, the external electrodes 60 easily follow the outer peripheral wall portion 22 and thus they are easily formable. Further, owing to the plating, so-called solder corrosion (thinning of the external electrodes 60 by solder when joining) which occurs in the external electrodes 60 can be prevented, and solder wettability can be obtained. However, the external electrodes 60 may be formed by applying metal such as silver for example on the outer peripheral wall portion 22.

Further, the external electrodes 60 and the coil terminals 31 are in electrical contact with each other. Specifically, the insulating film on the coil terminals 31 are melted by heat or the like, and thus the external electrodes 60 and the electric conductor of the coil 30 are in direct contact with each other.

For these external electrodes 60, it is possible to adopt a structure to protrude downward more than the bottom surface of the cup body 20, and when such a structure is adopted, the inductor 10 can be surface mounted on a circuit substrate or the like. However, when a structure to mount the inductance 10 element in surface mounting is not adopted, it is not necessary to adopt the structure in which the external electrodes 60 protrude downward more than the bottom surface of the cup body 20.

By adopting the above-described structure, magnetic flux generated by conducting an electric current to the coil 30 mainly passes the pressed body 40, the paste cured portion 50, and the cup body 20 in serial order. Here, "to mainly pass . . . in serial order" means that the magnetic flux passing through the pressed body 40, the paste cured portion 50, and the cup body 20 in serial order is larger than magnetic flux passing therethrough in a state that at least one of them is missing for example.

It should be noted that, although the above-described structure is the basic example of the inductor 10, it may be changed in various forms as long as the basic structure of the inductor 10 (magnetic flux mainly passes the pressed body 40, the paste cured portion 50, and the cup body 20 in serial order) is the same. Examples thereof will be shown below.

Figure 13:
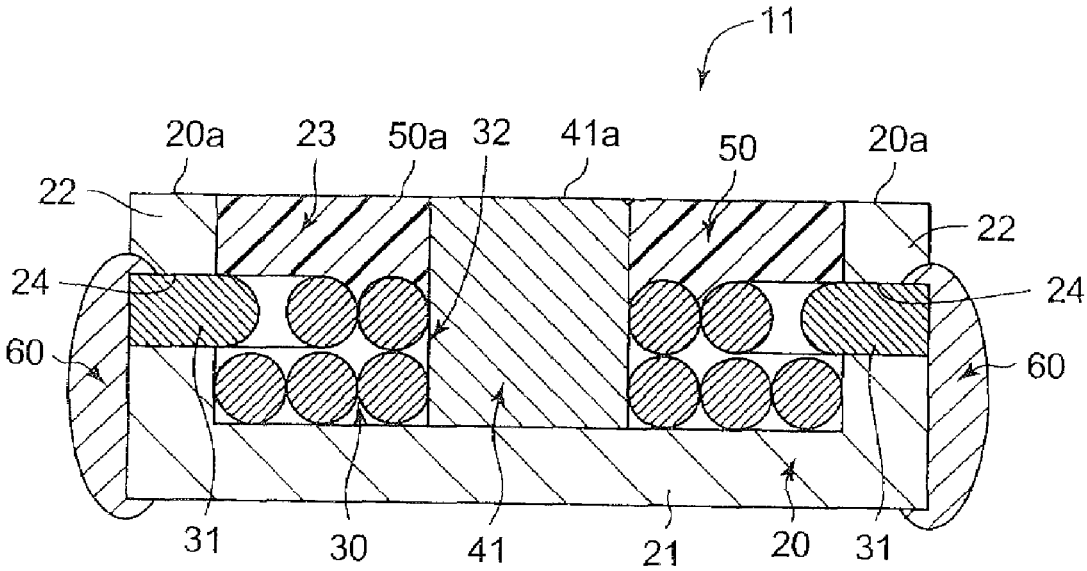
FIG. 13 is a cross-sectional side view showing the structure of an inductor according to a modification example of the second embodiment of the present invention in a state that a pressed body extends up to an upper end surface.

An inductor 11 shown in FIG. 13 has a structure in which an upper end surface 41*a* of a pressed body 41 is approximately level with (or exactly level with) an upper end surface 50*a* of the paste cured portion 50. Also in such a structure, magnetic flux mainly passes the pressed body 41, the paste cured portion 50, and the cup body 20 in serial order. Further, in this structure, the volume of the pressed body 41 is increased, and therefore an occupancy ratio of a portion where the filling ratio of the metal powder is high is improved.

Figure 14:
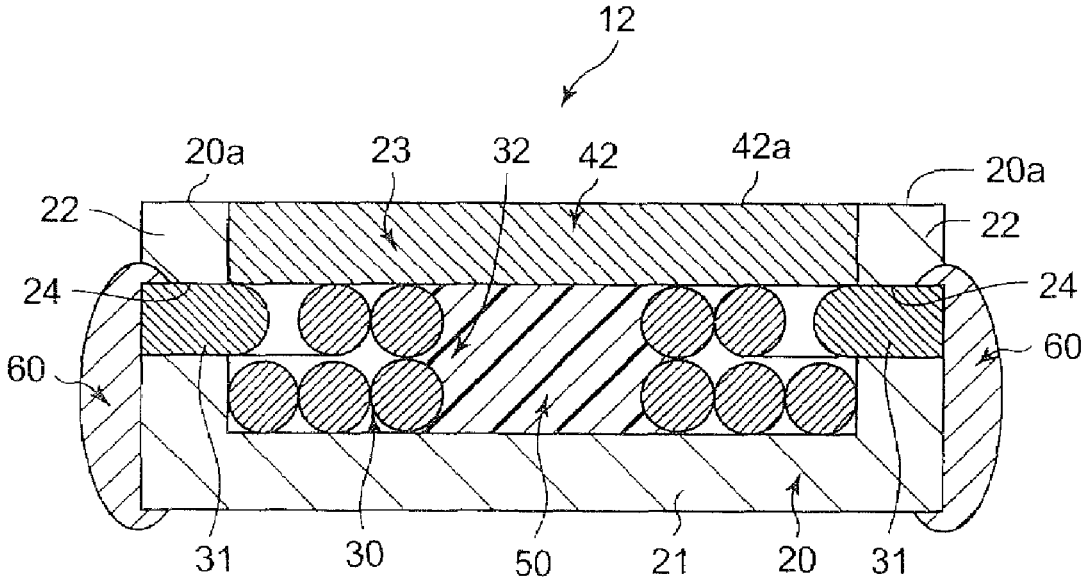
FIG. 14 is a cross-sectional side view showing the structure of an inductor according to a modification example of the second embodiment of the present invention in a state that a pressed body in a lid body shape is mounted on an upper end portion.

Further, an inductor 12 shown in FIG. 14 has a structure in which an upper end surface 42*a* of a pressed body 42 formed in a lid body shape (thin plate in a disc shape) is approximately level with (or exactly level with) an upper end surface 20*a* of the cup body 20. Also in such a structure, magnetic flux mainly passes the pressed body 42, the paste cured portion 50, and the cup body 20 in serial order.

Figure 15:
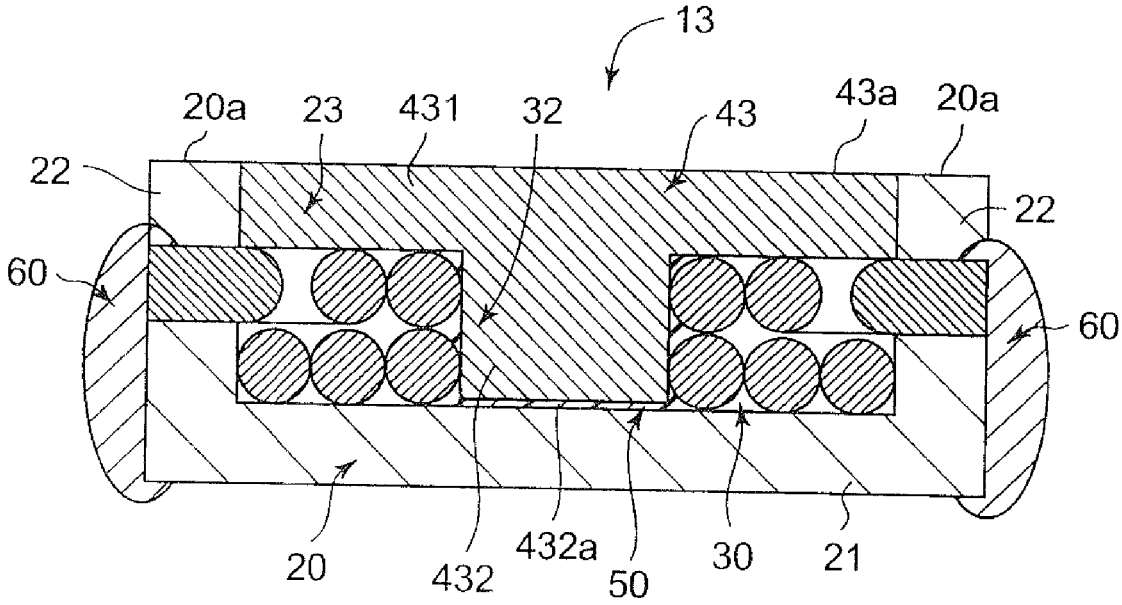
FIG. 15 is a cross-sectional side view showing the structure of an inductor according to a modification example of the second embodiment of the present invention in a state that a pressed body having a cross section which forms substantially a T shape is inserted from an upper side.

Furthermore, an inductor 13 shown in FIG. 15 has a structure in which an upper end surface 43*a* of a pressed body 43 whose cross section forms substantially a T side shape is approximately level with (or exactly level with) an upper end surface 20*a* of the cup body 20. In this case, the pressed body 43 is constituted of a lid body portion 431 and a column portion 432. Further, the paste cured portion 50 intervenes between a bottom surface 432*a* of the column portion 432 and the bottom portion 21. Accordingly, also in the structure in FIG. 15, magnetic flux mainly passes the pressed body 43, the paste cured portion 50, and the cup body 20 in serial order.

Figure 19:
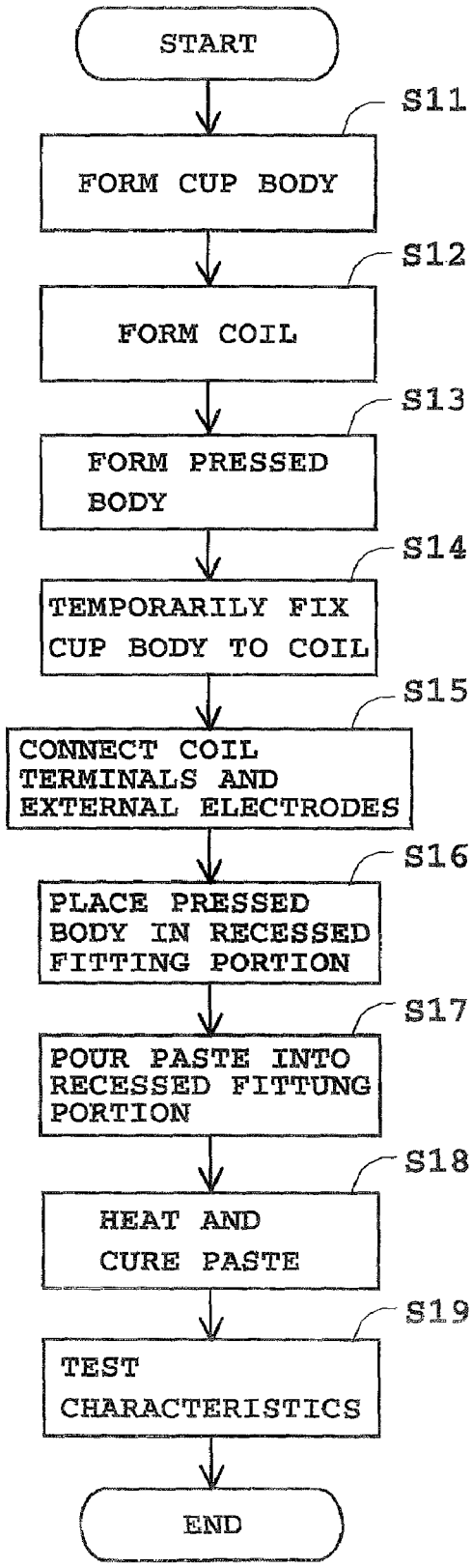
FIG. 19 is a flowchart showing a method of manufacturing the inductor shown in FIG. 12.
Figure 20:
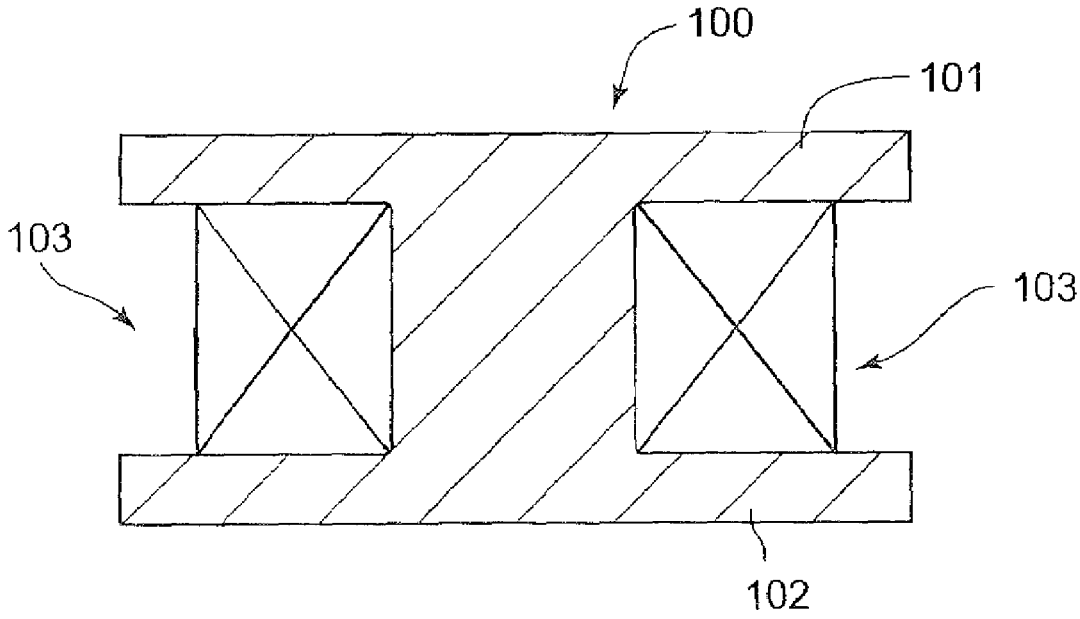
FIG. 20 is a cross-sectional side view showing the structure of a magnetic element having a conventional drum-type core.

Next, a method of manufacturing an inductor 10 having a structure as shown in FIG. 12 will be described based on a flowchart in FIG. 19. Incidentally, the flowchart shown in FIG. 19 describes the method of manufacturing the inductor 10 shown in FIG. 12.

First, a molded body that is the original form of the cup body 20 is formed from ferrite, and then the molded body is sintered. Furthermore, barrel polishing is performed on the molded body. Thus, the cup body 20 as shown in FIG. 12 is formed (step S11). Further, before or after step S11, a leading wire is wound for a predetermined number of times to form the coil 30 (step S12). Further, before or after these steps S11, S12, soft magnetic metal powder is press formed to form the pressed body 40 (step S13).

Subsequently, in a state that the axis of the cup body 20 and the axis of the coil 30 coincide with each other, the coil 30 is placed at the center portion of the bottom portion 21 of the recessed fitting portion 23 of the cup body 20, and the coil 30 is temporarily fixed there (step S14). In this case, along with the placement of the coil 30, the coil terminals 31 are passed through the holes 24 so that the end portions of the coil terminals 31 extend toward the outside of the recessed fitting portion 23. Next, the external electrodes 60 are formed on the outer peripheral side of the outer peripheral wall portion 22 of the cup body 20, and the coil terminals 31 and the external electrodes 60 are connected electrically (step S15). In this case, first, electrically conductive adhesive including resin is applied to the outer peripheral side of the outer peripheral wall portion 22 of the cup body 20. At this time, the electrically conductive adhesive is applied so as to cover the coil terminals 31. Then, after this electrically conductive adhesive cures, the surface of the cured matter of the adhesive is plated. At the time of this plating or at the time of heating in the case that the electrically conductive adhesive is heat treated, an insulating film of the conducing wire covering the electric conductor melts down, so that the electric conductor and the electrically conductive adhesive are connected electrically.

Incidentally, the external electrodes 60 may be formed after a later-described step S17 is finished. Further, the coil terminals 31 and the external electrodes 60 may be connected by soldering or the like for example.

Next, the pressed body 40 is placed in the coreless portion 32 of the coil 30 (step S16). In this case, the pressed body 40 is placed in a state that the lower surface thereof is in contact with the bottom portion 21. After this state, the paste is poured into the recessed fitting portion 23 (step S17). After such pouring of the paste, the paste is heated and cured at 150° C. for example (step S18). This pouring is carried out so that the matter pooled by pouring of the paste (the matter before curing to be the paste cured potion 50) is in a state approximately level with the upper end surface 20*a* of the cup body 20. Then, after a predetermined time passes, the paste cured portion 50 is formed, and thus the inductor 10 is produced.

Incidentally, after the paste cured portion 50 is formed, a work to remove an excess portion of the paste cured portion 50 (for example, a portion protruding higher than the upper end surface 20*a*) may be performed. Thereafter, a characteristic test (characteristic inspection) is performed on the inductor 10 (step S19) to complete the production.

Further, the method of manufacturing the inductor 11 is basically the same as that of the inductor 10 shown in FIG. 12. Further, for the inductors 12, 13 shown in FIG. 14, FIG. 15, placing of the pressed body 40 and pouring of the paste are reversed, but the other steps are the same as those shown in FIG. 12.

The operation of the inductor 10 having the above-described structure will be described below based on test results. Using the above-described inductor 10, an L value (value of inductance; unit μH) in the case that a current is made to flow in the coil 30 and a current value (unit A) which is decreased by 10% from the L value are shown in FIG. 16. Here, in FIG. 16, it is considered that the 10% decrease of the L value deteriorates a direct current superposition characteristic. Thus, the higher the current value, the more favorable the direct current superposition characteristic.

Figure 17:
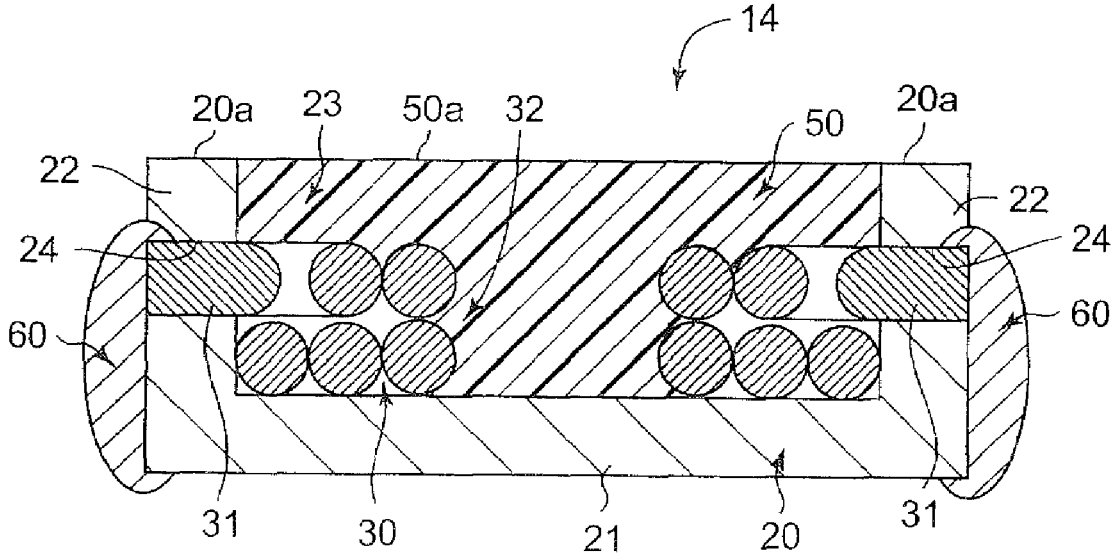
FIG. 17 is a cross-sectional side view related to the structure of an inductor for comparing characteristics with respective inductors according to the second embodiment of the present invention and showing the structure of the inductor in a state that the pressed body does not exist.

Incidentally, in FIG. 16, an inductance 14 exists as a comparison example, and the structure of this comparison example is shown in FIG. 17. In this FIG. 17, the pressed body 40 does not exist, and a cross-sectional side view of the inductor 14 in which only the paste cured portion 50 exists in the recessed fitting portion 23 is shown.

As shown in FIG. 16, it is seen that when a filling ratio is improved in the pressed body 40, the L value becomes high along with the improvement of the filling ratio. Specifically, the L value is maximum at 85% where the filling ratio is maximum. Further, it is seen that when the filling ratio is improved in the pressed body 40, a large current can be flown along with the improvement of the filling ratio, so that the direct current superposition characteristic improves. Specifically, also the value of the direct current superposition characteristic becomes high as the L value becomes high.

Further, in the inductors 10 to 13 having the structures shown in FIG. 12 to FIG. 15 respectively, an L value in the case of setting the powder filling ratio to 80% and a current value which is decreased by 10% from the L value are shown in FIG. 18. In results shown in this table, the structure in FIG. 15 exhibits the most favorable L value and L-10% characteristic. Incidentally, the inductor 13 shown in FIG. 15 has the pressed body 43 with the largest volume among the pressed bodies 40 to 43.

In the above-described results, when the filling ratio of metal powder improves, the L value becomes high and the direct current superposition characteristic becomes favorable. A cause thereof is such that when the coil 30 is covered only by the paste in the recessed fitting portion 23 and the organic solvent evaporates in the paste as it cures, air enters the position where the organic solvent existed to replace the organic solvent. Specifically, when the coil 30 is covered only by the paste cured portion 50, the filling ratio of metal powder decreases by the amount of thermosetting resin and the amount of entering air. On the contrary, in the case that the pressed body 40 in which the filling ratio of metal powder is increased is arranged in the recessed fitting portion 23, the thermosetting resin does not exists in the pressed body 40, and air is reduced therein by press forming, so that the arrangement enables increase in the amount of metal powder. Accordingly, an air gap existing in the recessed fitting portion 23 is reduced, and the L value can be increased. Further, in the metal powder, an appropriate amount of air gap still exists even after press forming, so that the direct current superposition characteristic does not decrease and thus becomes favorable.

In the inductor 10 having such a structure, as compared to conventional inductors, the pressed body 40 is arranged with the paste cured portion 50 inside the recessed fitting portion 23, so that the filling ratio of metal powder inside the recessed fitting portion 23 can be improved. Along with this improvement of the filling ratio, the magnetic permeability can be increased, and thus the L value can be increased.

Further, the pressed body 40 is formed using metal powder, so that the pressed body 40 has a structure including a predetermined air gap. Therefore, the direct current superposition characteristic does not deteriorate, which in turn becomes favorable as compared to the case that the pressed body 40 does not exist as shown in FIG. 17 (refer to FIG. 16). Accordingly, even when a large current is made to flow, an area where the L value does not decrease can be extended. In other words, it becomes possible to let a large current to flow.

Furthermore, being different from a drum-type inductor (magnetic element), this structure does not include a drum-type core. Accordingly, a need of thinning an upper flange portion and a lower flange portion of the drum-type core can be eliminated, so that decrease in strength of the inductor 10 can be prevented. Further, since the decrease in strength can be prevented, it becomes possible to further downsize the inductor 10.

Further, in the above-described inductor 10, the cup body 20 made of insulative ferrite intervenes between the metal powder (pressed body 40, the paste cured portion 50) and the external electrodes 60. Accordingly, insulation can be secured between the pressed body 40 and paste cured portion 50 including the metal powder and the external electrodes 60. Therefore, it becomes possible to prevent the decrease of L value and the like which occurs when the insulation is not secured.

Furthermore, in the inductor 10 having the above-described structure, an air gap such as that in the drum-type core does not exist, so that leakage of magnetic flux to the outside can be reduced. Further, in the above-described inductor 10, a cup type is adopted as the first core member. Specifically, this structure does not include the drum-type core having the upper flange portion and the lower flange portion, so that when it is attempted to thin the inductor 10, it is not necessary to thin the upper flange portion and the lower flange portion. Therefore, when it is attempted to thin the inductor 10, strength of the inductor 10 can be secured.

Further, in the inductor 11 of the type shown in FIG. 13, the volume of the pressed body 41 can be increased more than that in the case of the inductor 10 of the type shown in FIG. 12. Accordingly, in the recessed fitting portion 23, a part having high magnetic permeability can be made larger than that in the inductor 10 in FIG. 12, and it becomes possible to increase the L value. Further, in the inductor 11, the direct current superposition characteristic can be made more favorable than that in the inductor 10 in FIG. 12 (refer to FIG. 18).

Furthermore, in the inductor 12 of the type shown in FIG. 14, the pressed body 42 is formed in a lid body shape. Accordingly, also in the inductor 12 shown in FIG. 14, the volume of the pressed body 42 having high magnetic permeability can be increased inside the recessed fitting portion 23, and thus it becomes possible to achieve the same advantages as those of the inductor 10 in FIG. 12.

Further, in the inductor 13 of the type shown in FIG. 15, the pressed body 43 has a cross section which forms substantially a T shape. Accordingly, also in the inductor 13 shown in FIG. 15, the volume of the pressed body 43 having high magnetic permeability can be increased inside the recessed fitting portion 23. In addition, in the inductor 13 of this type, the L value and the direct current superposition characteristic can be made favorable as compared to the inductors 10, 11, 12 of the types shown respectively in FIG. 12 to FIG. 14 (refer to FIG. 18). Accordingly, the function as an inductor becomes excellent.

Further, in the above-described embodiment, the paste curing portion 50 is formed by curing of paste having fluidity and including thermosetting resin. Accordingly, the paste cured portion 50 can enter spaces between small recesses and projections existing in the coil 30 or the cup body 20. Further, by securing fluidity in the paste, the inductor 10 can be easily manufactured, so that the productivity can be improved. Further, curing of the uncured paste makes the coil 30 and the pressed body 40 adhere securely to the cup body 20.

Furthermore, in the above-described embodiment, the pressed body 40 is formed by press forming. Accordingly, air gaps existing in metal powder can be reduced by the press forming, and the powder filling ratio of the pressed body 40 can be surely increased. Thus, arrangement of the pressed body 40 in which air gaps are reduced inside the recessed fitting portion 23 enables secure improvement of the magnetic permeability and inductance of the inductor 10.

Further, in the above-described inductor 10, in magnetic flux generated from the coil 30, magnetic flux passing through inside of the cup body 20, inside of the paste cured portion 50, and inside of the pressed body 40 one by one in serial order is larger than magnetic flux passing therethrough in a state that at least one of them is excluded. Specifically, the magnetic flux passing through inside of the pressed body 40 having high magnetic permeability is large, so that the L value of the inductor 10 can be improved.

Further, the inductor 10 is constituted of the cup body 20. Accordingly, the coil 30 and the pressed body 40 can be easily arranged in the recessed fitting portion 23. Here, since the paste has fluidity, it can be favorably stored in the recessed fitting portion 23. Thus, manufacture of the inductor 10 becomes simple, and productivity of the inductor 10 can be improved.

Further, the inductor 10 does not include the drum-type core having the upper flange portion and the lower flange portion but includes the cup body 20. Therefore, when it is attempted to make the inductor 10 thinner, thinning of the upper flange portion and the lower flange portion as performed in thinning of the drum-type core is not necessary. Accordingly, when the inductor 10 is made thinner, strength of the inductor 10 can be secured.

Further, the pressed body 40 is formed by press forming of powder metal, so that a current hardly flows as compared to a bulk material (agglomerate) of metal. Accordingly, an eddy current loss as that in the case of using a bulk material hardly occurs, so that a heating value in the inductor 10 can be made small.

In the foregoing, embodiments of the present invention have been described. However, the present invention can be changed in various forms besides them, which will be described below.

In the above-described embodiments, the case of adopting the cup body 20 as the first core member is described. However, the first core member is not limited to the cup body 20. For example, the first core member may be formed in a ring shape. In this case, the inductor 10 may adopt a structure to arrange an additional bottom lid member at a bottom portion of the ring shape or may adopt a structure not to arranged the bottom lid member.

Further, in the above-described embodiments, the external electrodes 60 is formed using electrically conductive adhesive and by plating the surface of the applied electrically conductive adhesive. However, the external electrodes 60 are not limited to such structure. For example, a metal plate is attached to follow the outer peripheral wall portion 22, and this metal plate can be the external electrodes.

Furthermore, in the above-described embodiments, the pressed body 40 as the third core member is formed by press forming. However, a method other than the press forming may be adopted if it can improve the powder filling ratio of metal powder. As an example thereof, it is conceivable to form the third core member by sintering.

Further, in the above-described embodiments, the example of forming the coil 30 by a round wire is shown in the diagrams (refer to FIG. 12 to FIG. 15, and so on). However, the conducting wire constituting the coil 30 is not limited to the round wire, and a conducting wire other than the round wire such as a flat wire may be used.

Further, in the above-described embodiments, the inductor 10 among magnetic elements is described. However, the magnetic element is not limited to an inductor. For example, to a structure using a coil such as transformer, filter, and the like, the structure of the present invention (the coil, the first core member, the second core member, and the third core member) can be applied. Further, in the above-described embodiments, the magnetic element using the winding coil is described. However, the present invention may be applied to a magnetic element of lamination type or thin film type which does not use a coil.

The magnetic element according to the present invention can be used in the field of electric equipment.

What is claimed is:

1. A magnetic element, comprising:

a coil having end portions;

a first core member constituted of insulative soft magnetic ferrite; said first core member having a bottom portion and side walls; said side walls having recessed fitting portions that do not reach the bottom portion of said first core; wherein the number of recessed fitting portions correspond to the number of end portions of said coil;

a second core member comprised of a magnetic metal powder and a resin; said second core member being arranged into said first core member;

and a third core member having soft magnetic metal powder as material, having higher magnetic permeability than said second core member said third core member being arranged into said first core member; and terminal electrodes being formed on outside of said first core member so as not to attach to said second core member and said third core member; wherein said end portions of said coil extend out of said recessed fitting portions respectively to be connected to said terminal electrodes.

2. The magnetic element according to claim 1, wherein in magnetic flux generated from said coil, a part passing through said first core member, said second core member and said third core member one by one in serial order is larger than a part passing there through with at least one of said core members being excluded.

3. The magnetic element according to claim 1, wherein said third core member is formed in a column shape, an end surface of one end side of the column shape is mounted on a bottom portion of the cup body, and said third core member in the column shape is covered by said second core member.

4. The magnetic element according to claim 1, wherein said third core member is formed in a column shape, an end surface of one end side of the column shape is mounted on a bottom portion of the cup body, and said third core member in the column shape is formed to be level with an end surface of said second core member.

5. The magnetic element according to claim 1, wherein said third core member is formed in a lid body shape, and said third core member in the lid body shape is mounted on said second core member or said coil and blocks an opening portion of said cup body.

6. The magnetic element according to claim 1, wherein said third core member comprises a lid body portion in a lid body shape and a column portion in a column shape extending in a normal direction of said lid body portion from a center portion of said lid body portion, wherein with said lid body portion and said column portion, a cross section of said third core member forms a T shape, and wherein between said third core member and a bottom portion of said cup body, said second core member intervenes.

7. The magnetic element according to claim 1, wherein said coil is formed by patterning of metal on a heat resistant resin film.

8. The magnetic element according to claim 1, wherein between windings of said coil, said second core member does not exist.

9. The magnetic element according to claim 1, further comprising external electrodes electrically connected to said coil and attached to an outer peripheral surface of said first core member, wherein said external electrodes is formed of electrically conductive adhesive as material.

* * * * *